US007526233B2

(12) United States Patent
Kamiya

(10) Patent No.: US 7,526,233 B2
(45) Date of Patent: Apr. 28, 2009

(54) DRIVING DEVICE, AN IMAGE FORMING DEVICE, AND AN IMAGE FORMING APPARATUS

(75) Inventor: Takuro Kamiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 126 days.

(21) Appl. No.: 11/634,150

(22) Filed: Dec. 6, 2006

(65) Prior Publication Data

US 2007/0183810 A1 Aug. 9, 2007

(30) Foreign Application Priority Data

Dec. 6, 2005 (JP) ..... 2005-351922
Sep. 25, 2006 (JP) ..... 2006-258260

(51) Int. Cl.
*G03G 15/00* (2006.01)

(52) U.S. Cl. ..... 399/167

(58) Field of Classification Search ..... 399/38, 399/53, 112, 167
See application file for complete search history.

(56) References Cited

U.S. PATENT DOCUMENTS 6,016,416 A * 1/2000 Kitamura ..... 399/167
7,317,889 B2 * 1/2008 Suzuki ..... 399/167 X

FOREIGN PATENT DOCUMENTS

JP 2002-123130 4/2002
JP 2002-189325 7/2002
JP 2003-140424 5/2003

* cited by examiner

*Primary Examiner*—Sandra L Brase
(74) *Attorney, Agent, or Firm*—Harness, Dickey & Pierce PLC

(57) ABSTRACT

A driving device, an image forming device, and an image forming apparatus are disclosed. In at least one embodiment, the image forming device includes a first rotator and a second rotator, which are arranged in parallel with each other. The driving device rotates the first rotator with a rotational speed different from a rotational speed of the second rotator.

21 Claims, 8 Drawing Sheets

DRIVING DEVICE, AN IMAGE FORMING DEVICE, AND AN IMAGE FORMING APPARATUS

CROSS-REFERENCE TO RELATED APPLICATIONS

This patent application is based on and claims priority under 35 U.S.C. §119 to Japanese patent application Nos. 2005-351922 filed on Dec. 6, 2005, and 2006-258260 filed on Sep. 25, 2006, in the Japanese Patent Office, the entire contents of each which is hereby incorporated herein by reference.

1. Field

Example embodiments of the present invention relate generally to a driving device, an image forming device incorporating the driving device, and/or an image forming apparatus, for example one incorporating at least one of the driving device and the image forming device.

2. Description of the Related Art

In the tandem-type image forming apparatus, a plurality of image forming devices are arranged side by side. With this structure, the tandem-type image forming apparatus tends to be more costly and larger in apparatus size than the single-drum type image forming apparatus. In order to suppress the cost or size, the plurality of image forming devices are usually designed to have structures that are substantially similar. For example, driving devices that are provided respectively for the image forming devices of different colors may have the same structure. While providing the driving devices of the same structure may be cost effective, this may increase the adverse effect of vibrations, when vibrations are generated from the driving devices.

For example, a first driving device A for driving a first image forming device and a second driving device B for driving a second image forming device are assumed to be provided side by side. The first driving device A and the second driving device B have the same structure, each of which includes a drive motor for generating a drive force and a force transmitter for transmitting the drive force to one or more elements of the corresponding one of the first and second image forming devices. When the drive force is transmitted through the force transmitter, vibration may be generated.

Further, since the first driving device A and the second driving device B have the same structure, as illustrated in FIG. 1, the vibration frequency of vibration Va generated by the first driving device A and the vibration frequency of vibration Vb generated by the second driving device B tend to be equal. Further, the first driving device A and the second driving device B tend to vibrate in phase.

As a result, when the vibration Va and the vibration Vb are accumulated, the resultant accumulated vibration Ve may have a large vibration amplitude. For example, as illustrated in FIG. 1, the vibration amplitude of the accumulated vibration Ve may be twice the vibration amplitude of the vibration Va or the vibration Vb. The vibration amplitude of the accumulated vibration Ve tends to be large especially when the first driving device A and the second driving device B are fixed to the same structure. Further, when the first image forming device driven by the first driving device A and the second image forming device driven by the second driving device B are fixed to the same structure, the accumulated vibration Ve may be easily transmitted to other elements of the first image forming device and other elements of the second image forming device. As a result, an image formed by the first and second image forming devices may suffer from banding.

The Japanese Patent Application Publication No. 2002-189325 discloses a driving device, which prevents lowering of the image quality caused by the increased vibration amplitude of the vibration generated by idler gears, by making the module and, the number of teeth different between the large gears and the small gears. However, providing different types of gears may increase the manufacturing cost or time.

BRIEF SUMMARY OF THE INVENTION

Example embodiments of the present invention include a driving device, an image forming device incorporating the driving device, and/or an image forming apparatus incorporating the driving device or the image forming device.

In one example embodiment, a plurality of image forming devices are provided in an image forming apparatus, including a first image forming device and a second image forming device. The first image forming device includes a first photoconductor that is rotatable, and a first rotator that rotates asynchronously with the rotation of the first photoconductor. The second image forming device includes a second photoconductor that is rotatable, and a second rotator that rotates asynchronously with the rotation of the second photoconductor. The first rotator and the second rotator rotate with the rotational speeds that are different from each other.

BRIEF DESCRIPTION OF THE DRAWINGS

A more complete appreciation of the disclosure and many of the attendant advantages thereof will be readily obtained as the same becomes better understood by reference to the following detailed description of example embodiments when considered in connection with the accompanying drawings, wherein.

DETAILED DESCRIPTION OF THE EXAMPLE EMBODIMENTS

In describing the example embodiments illustrated in-the drawings, specific terminology is employed for clarity. However, the disclosure of this patent specification is not intended to be limited to the specific terminology selected and it is to be understood that each specific element includes all technical equivalents that operate in a similar manner. For example, the singular forms "a", "an" and "the" may include the plural forms as well, unless the context clearly indicates otherwise.

Figure 2:
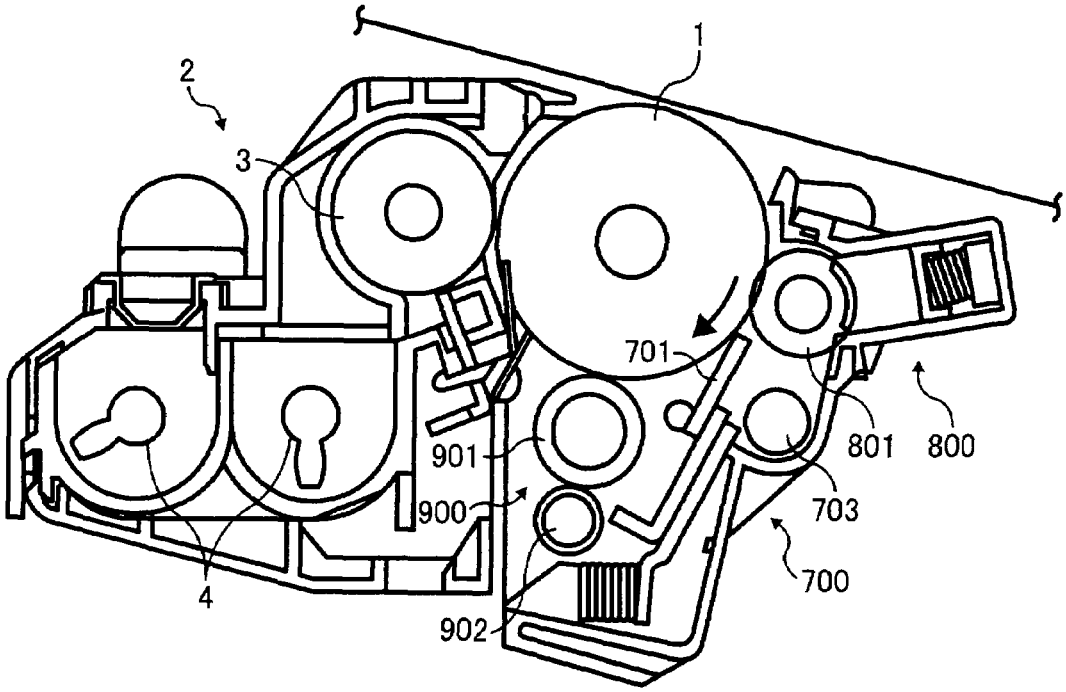
FIG. 2 is-a cross-sectional view illustrating the structure of an image forming device according to an example embodiment of the present invention.

Referring now to the drawings, wherein like reference numerals designate identical or corresponding parts throughout the several views, FIG. 2 illustrates an image forming device according to an example embodiment of the present invention. Referring to FIG. 2, the image forming device includes a photoconductor 1, a charging device 900 including a charging roller 901 and a cleaning roller 902, a developing device 2 including a developing roller 3 and an agitator 4, a cleaning device 700 including a cleaning blade 701 and a collection screw 703, and an applying device 800 including an applying roller 801.

Figure 5:
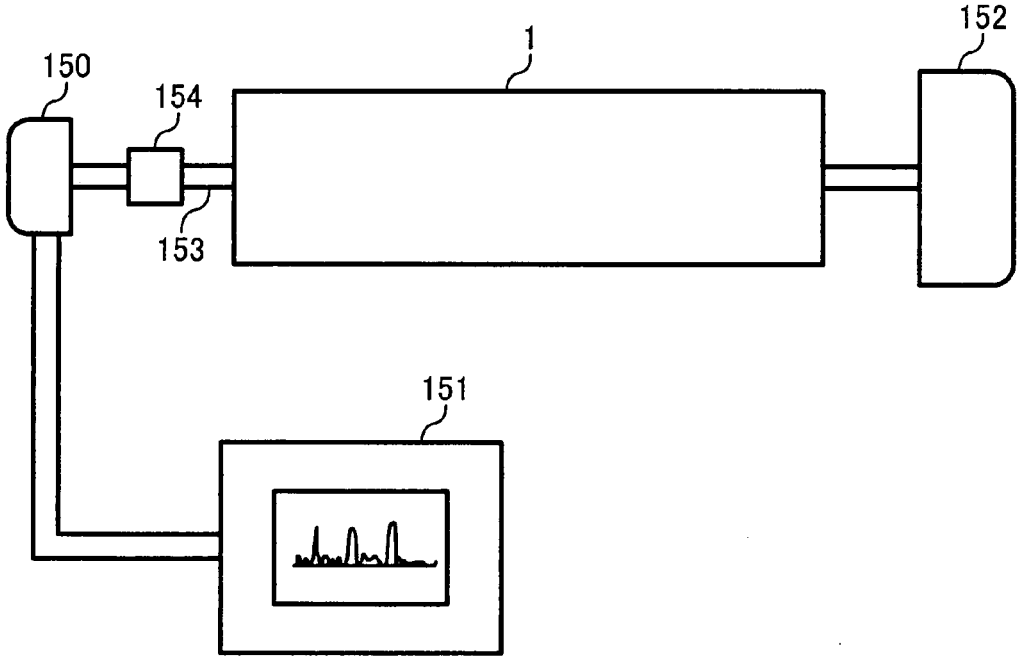
FIG. 5 is a schematic diagram illustrating operation of determining a desired rotational speed difference according to an example embodiment of the present invention.

The charging roller 901 uniformly charges the surface of the photoconductor 1, which is rotatably driven by a photoconductor driving device 152 (FIG. 5). In this example, the photoconductor 1 has a drum shape, for example, as illustrated in FIG. 5. The cleaning roller 902 cleans the surface of the charging roller 901. An electrostatic latent image is formed on the charged surface of the photoconductor 1.

With the rotation of the photoconductor 1, the latent image is carried in the direction indicated by the arrow (FIG. 2). The developing roller 3 develops the latent image into a toner image, by applying toner onto the surface of the photoconductor 1. The density of the toner is kept uniform by the agitator 4. The agitator 4 includes two agitating screws, each of which agitates the toner stored in the developing device 2.

After the toner image is transferred, for example, onto an intermediate transfer body, the cleaning blade 701 removes residual toner from the surface of the photoconductor 1. The toner is collected by the collection screw 703. The applying roller 801, which may be a brush-type, applies a lubrication agent to the surface of the photoconductor 1.

In this example, the image forming device includes at least one rotator, which rotates asynchronously with the photoconductor 1. Examples of the rotator include the developing roller 3, the agitator 4, the collection screw 703, and the applying roller 801. In this specification, the charging roller 901 and the cleaning roller 902 are not interpreted as the rotator as they are designed to rotate synchronously with the photoconductor 1. The rotator is rotatably rotated by a driving device provided in the image forming device, which is different from the photoconductor driving device 152.

As described below referring to FIG. 3, the driving device includes a drive source for generating a drive force, and a force transmitter for transmitting the drive force from the drive source to the rotator. The drive source may be implemented by any kind of drive motor, for example, a direct current (DC) motor, an alternate current (AC) motor, a servo motor, a stepping motor, etc. The force transmitter may be implemented by one or more elements capable of transmitting the drive force, including, for example, a gear, a belt, a chain, a wheel, etc.

As described below referring to FIG. 3, the force transmitter may have the function of controlling the rotational speed, for example, by converting an input rotational speed input from the drive source to an output rotational speed output to the rotator according to a reduction ratio. The force transmitter may further include one or more elements capable of detecting the rotational speed of the rotator, including, for example, a pick-up device.

Figure 3:
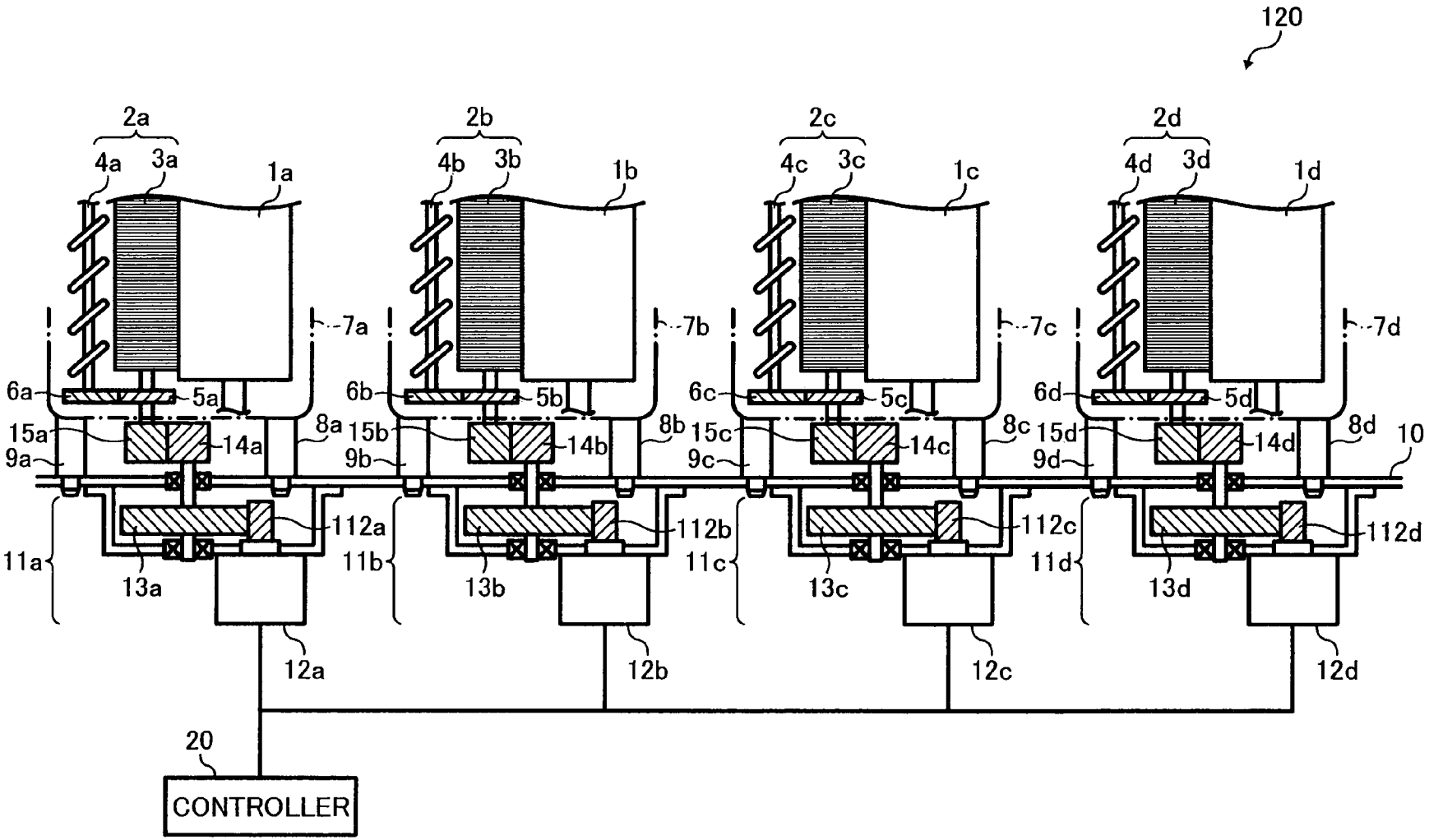
FIG. 3 is a cross-sectional view illustrating a portion of a tandem-type image forming device according to an example embodiment of the present invention.

Referring now to FIG. 3, the structure of a tandem-type image forming device 120 including a driving device 11 and a rotator driven by the driving device 11 is explained according to an example embodiment of the present invention. In this example, a plurality of driving devices 11*a*, 11*b*, 11*c*, and 11*d* (collectively referred to as the "driving device 11") are arranged in parallel with one another in the tandem-type image forming apparatus 120. Further, a plurality of photoconductors 1*a*, 1*b*, 1*c*, and 1*d* (collectively referred to as the "photoconductor 1") are arranged in parallel with one another in the tandem-type image forming device 120. Further, a plurality of rotators are arranged in parallel with one another in the tandem-type image forming device 120. As illustrated in FIG. 3, in this example, the rotator (collectively referencing the plurality of rotators) corresponds to the developing device 2 (collectively referencing the plurality of developing devices 2*a*, 2*b*, 2*c*, and 2*d*) including the developing roller 3 (collectively referencing the plurality of developing rollers 3*a*, 3*b*, 3*c*, and 3*d*) and the agitator 4 (collectively referencing the plurality of agitators 4*a*, 4*b*, 4*c*, and 4*d*). However, any desired rotator may be provided as the rotator in alternative or in addition to the developing device 2 as describe above referring to FIG. 2.

In this example, the photoconductor 1*a*, the developing device 2*a*, and the driving device 11*a* form a first image forming device. The photoconductor 1*b*, the developing device 2*b*, and the driving device 11*b* form a second image forming device. The photoconductor 1*c*, the developing device 2*c*, and the driving device 11*c* form a third image forming device. The photoconductor 1*d*, the developing device 2*d*, and the driving device 11*d* form a fourth image forming device.

Referring to FIG. 3, the photoconductor 1 and the developing device 2 are arranged in a substantially similar manner for all image forming devices. As shown in FIG. 3, the developing device 2 is provided adjacent to the photoconductor 1. A gear 5, which is provided on a shaft of the developing roller 3, rotates together with the rotation of the developing roller 3. The agitator 4, which is provided adjacent to the developing roller 3, has a gear 6 mounted on a shaft of the agitator 4.

Since the gear 5 and the gear 6 are in mesh, the developing roller 3 and the agitator 4 are rotated together by a drive force transmitted from the driving device 11 via two gears 14 and 15. In this example, the gear 5 and the gear 6 are similar in diameter size or number of teeth. Further, while the developing device 2 is driven by the driving device 11, the photoconductor 1 is driven by a driving device that is different from the driving device 11, such as the photoconductor driving device 152 of FIG. 5.

Still referring to FIG. 3, the driving devices 11*a*, 11*b*, 11*c*, and 11*d* have the same mechanical structures. The driving device 11 includes a motor 12, a drive gear 112, and a reduction gear 13. The driving device 11 is coupled to a controller 20. The controller 20, which controls operation of the motor 12, may include a central processing unit (CPU), a motor controller, or a current driver, etc.

In this example, the photoconductor 1, the developing device 2, and the driving device 11 are integrally provided in the tandem-type image forming device 120. As illustrated in FIG. 3, the photoconductor 1 and the developing device 2 are supported by a housing 7, which is fixed to an apparatus body 10 through two supporters 8 and 9. The driving device 11 is also fixed to the apparatus body 10.

In operation, upon receiving a control signal from the controller 20, the motor 12 rotates with an input rotational speed determined by the control signal to generate a drive force for driving the rotator, i.e., the developing device 2. The drive force is transmitted to the developing device 2 through the drive gear 112 and the reduction gear 13, and further through the gears 14 and 15. The drive gear 112, which is provided on a shaft of the motor 12, rotates together with the rotation of the motor 12.

The drive force is transmitted from the drive motor 12 to the drive gear 112. Since the drive gear 112 and the reduction gear 13 are in mesh, the reduction gear 13 rotates with the rotation of the drive gear 112. The drive force is transmitted from the drive gear 112 to the reduction gear 13.

In this example, the reduction gear 13 is larger in diameter size or number of teeth than the drive gear 112. As the drive force is transmitted from the drive gear 112 to the reduction gear 13, the input rotational speed is converted to an output rotational speed that is less than the input rotational speed, according to the reduction ratio.

In this example, the reduction ratio may be defined as the ratio of the diameter size or the number of teeth between the drive gear 112 and the reduction gear 13. The drive force is output to the gear 14, which is provided on the shaft of the reduction gear 13, and farther to the developing roller 3 through the gear 14. The developing roller 3 rotates with the output rotational speed.

Figure 1:
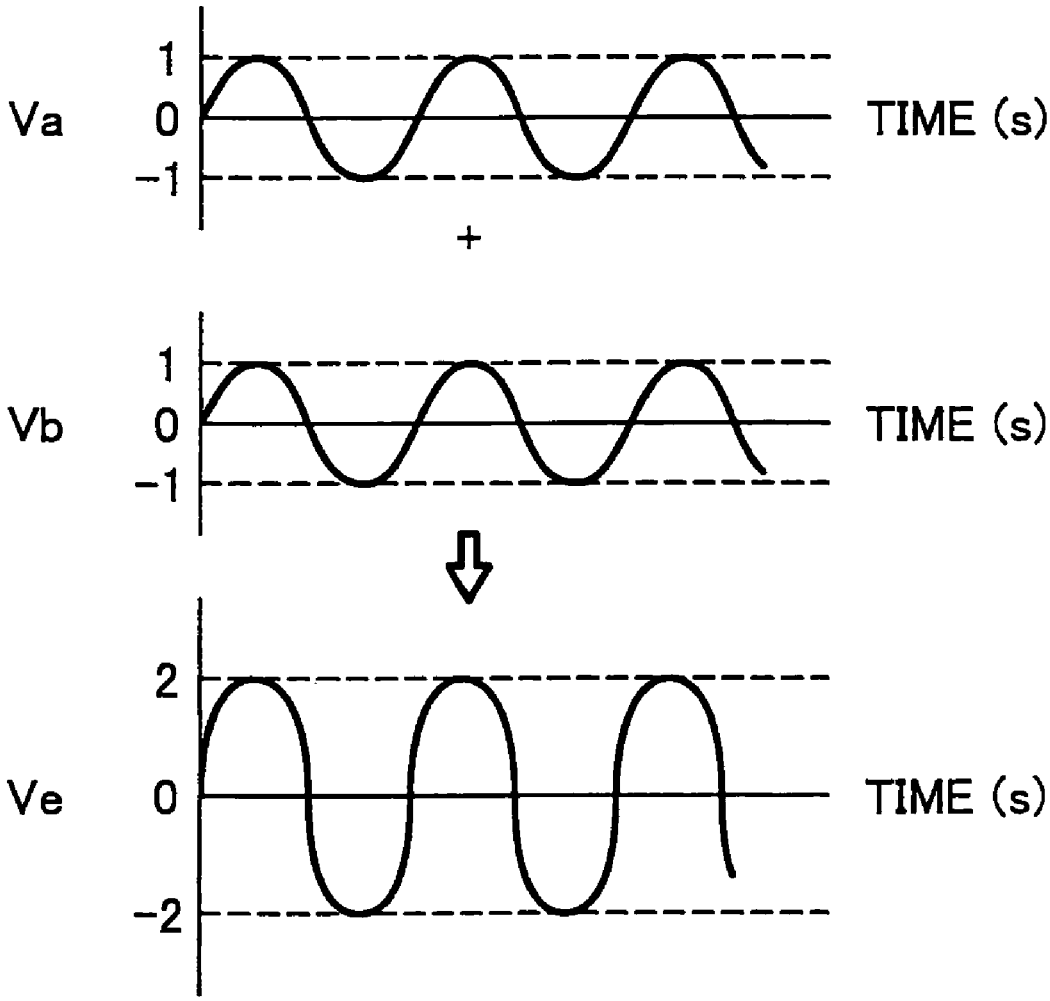
FIG. 1 RELATED ART
FIG. 1 is a timing chart illustrating accumulation of vibrations generated by driving devices.

Since the driving devices 11*a*, 11*b*, 11*c*, and 11*d* have the same mechanical structures, the vibration frequencies generated by the driving devices 11*a*, 11*b*, 11*c*, and 11*d* tend to be equal when the motors 12*a*, 12*b*, 12*c*, and 12*d* rotate with the same rotational speeds. In this example, the vibration frequencies may be caused by the gear mesh, which can be hardly controlled. As a result, as described above referring to FIG. 1, the resultant accumulated vibration may have the large vibration amplitude. Further, since the photoconductor 1, the developing device 2, and the driving device 11 are integrally provided in the tandem-type image forming device 120, the accumulated vibration may have an adverse effect on the quality of an image formed by the tandem-type image forming device 120.

In order to decrease the vibration amplitude of the accumulated vibration, the controller 30 may cause each one of the motors 12*a*, 12*b*, 12*c*, and 12*d* to rotate with input rotational speeds that are difference from one another. In one example, when the motor 12 is implemented by a DC motor, the clock frequencies are set to be different for the motors 12*a*, 12*b*, 12*c*, and 12*d*. In another example, when the motor 12 is implemented by an AC motor, the AC supply frequencies are set to be different for the motors 12*a*, 12*b*, 12*c* and 12*d*. In another example, when the motor 12 is implemented by a stepping motor, the number of pulses are set to be different for the motors 12*a*, 12*b*, 12*c*, and 12*d*. As a result, the developing devices 2*a*, 2*b*, 2*c*, and 2*d* are caused to rotate with output rotational speeds that are different from one another. Accordingly, the vibration amplitude of the accumulated vibration may be reduced.

Figure 4:
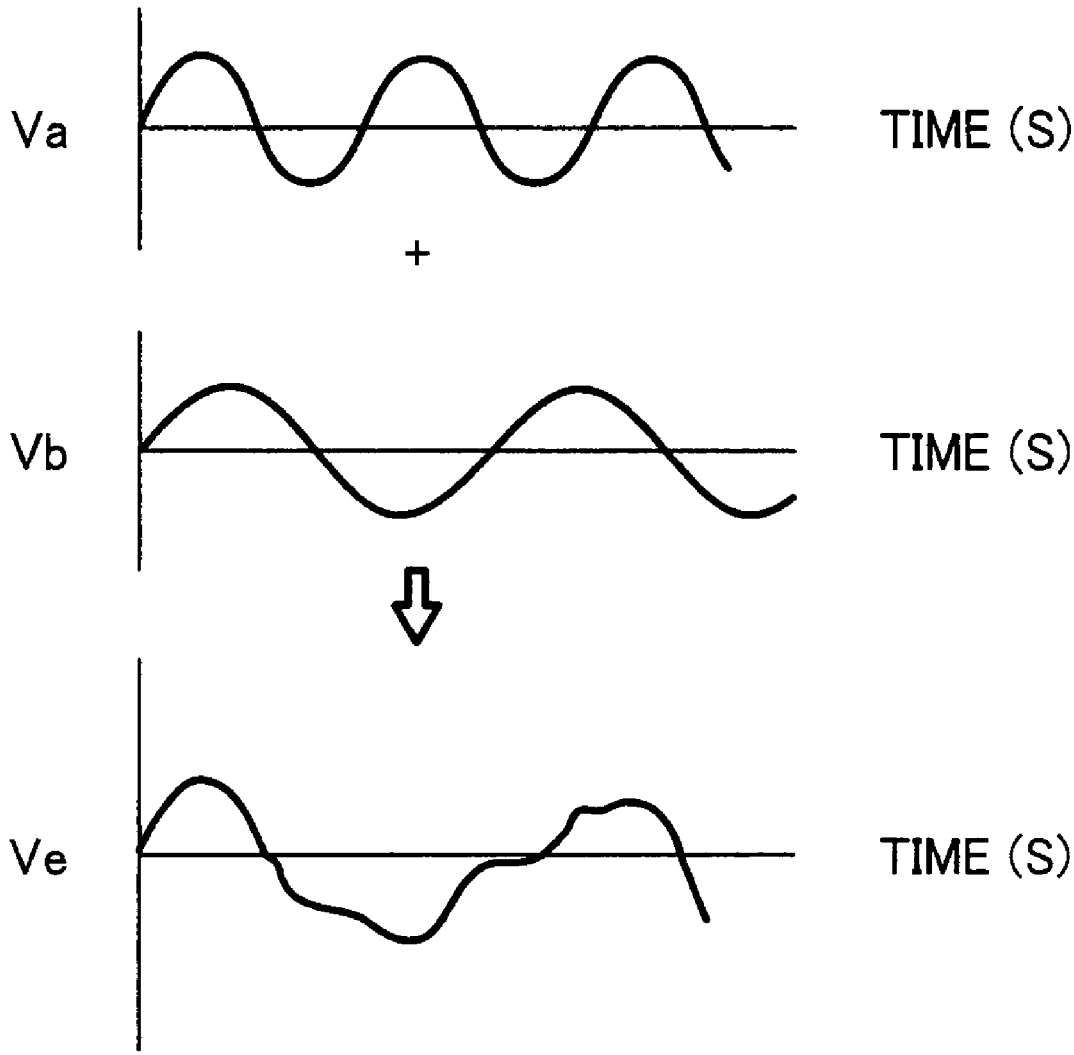
FIG. 4 is a timing chart illustrating controlling of vibrations generated by driving devices.

For example, FIG. 4 illustrates vibration Va generated by the driving device 11*a*, and vibration Vb generated by the driving device 11*b*, according to an example embodiment of the present invention. Since the input rotational speeds are set differently for the driving devices 11*a* and 11*b*, the vibration frequencies tend to be different for the vibration Va and the vibration Vb. Accordingly, the resultant accumulated vibration Ve tends to have the vibration amplitude, which is smaller than the vibration amplitude of the vibration Va or the vibration Vb.

Figure 6:
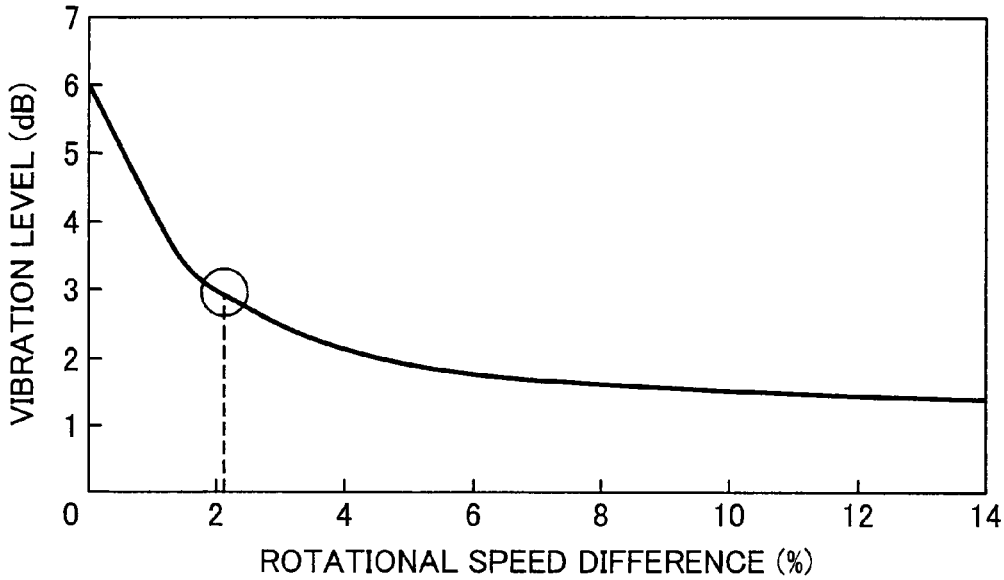
FIG. 6 is a graph illustrating the relationship between a vibration level and a rotational speed difference according to an example embodiment of the present invention.

Referring now to FIGS. 5 and 6, determining a desired rotational speed difference is explained according to an example embodiment of the present invention. The desired rotational speed difference corresponds to the amount of difference in rotational speed among a plurality of driving devices, which can sufficiently suppress the adverse effect of the vibration frequency of the accumulated vibration generated by the plurality of driving devices. The desired rotational speed difference may be obtained, for example, by observing the level of the accumulated vibration when two different input rotational speeds are applied to two different motors 12*a* and 12*b* (FIG. 3).

The accumulated vibration may be obtained in various ways. In one example, as illustrated in FIG. 5, an encoder 150 may be provided on a shaft 153 of the photoconductor 1 through a coupling device 154. The encoder 150 is coupled to an analyzer 151, such as an FFT (Fast Fourier Transform) analyzer. The analyzer 151 detects the fluctuations in rotation of the photoconductor 1, which may be used as the vibration level of the accumulated vibration. In another example, an acceleration pick-up device may be provided in the driving device 11, which is coupled to the rotator driven by the driving device 11. The analyzer 151 detects the level of accumulated vibration from a signal output from the acceleration pick-up device.

Based on the data output by the analyzer 151, the relationship between the vibration level and the rotational speed difference may be obtained as illustrated in FIG. 6. Referring to FIG. 6, when the rotational speed difference is set to equal to or more than 2 percent, the vibration level decreases almost by half. When the rotational speed difference is set to less than 2 percent, the vibration level stays relatively high. Accordingly, the desired rotational speed difference may be set to equal to or greater than 2 percent.

Figure 7:
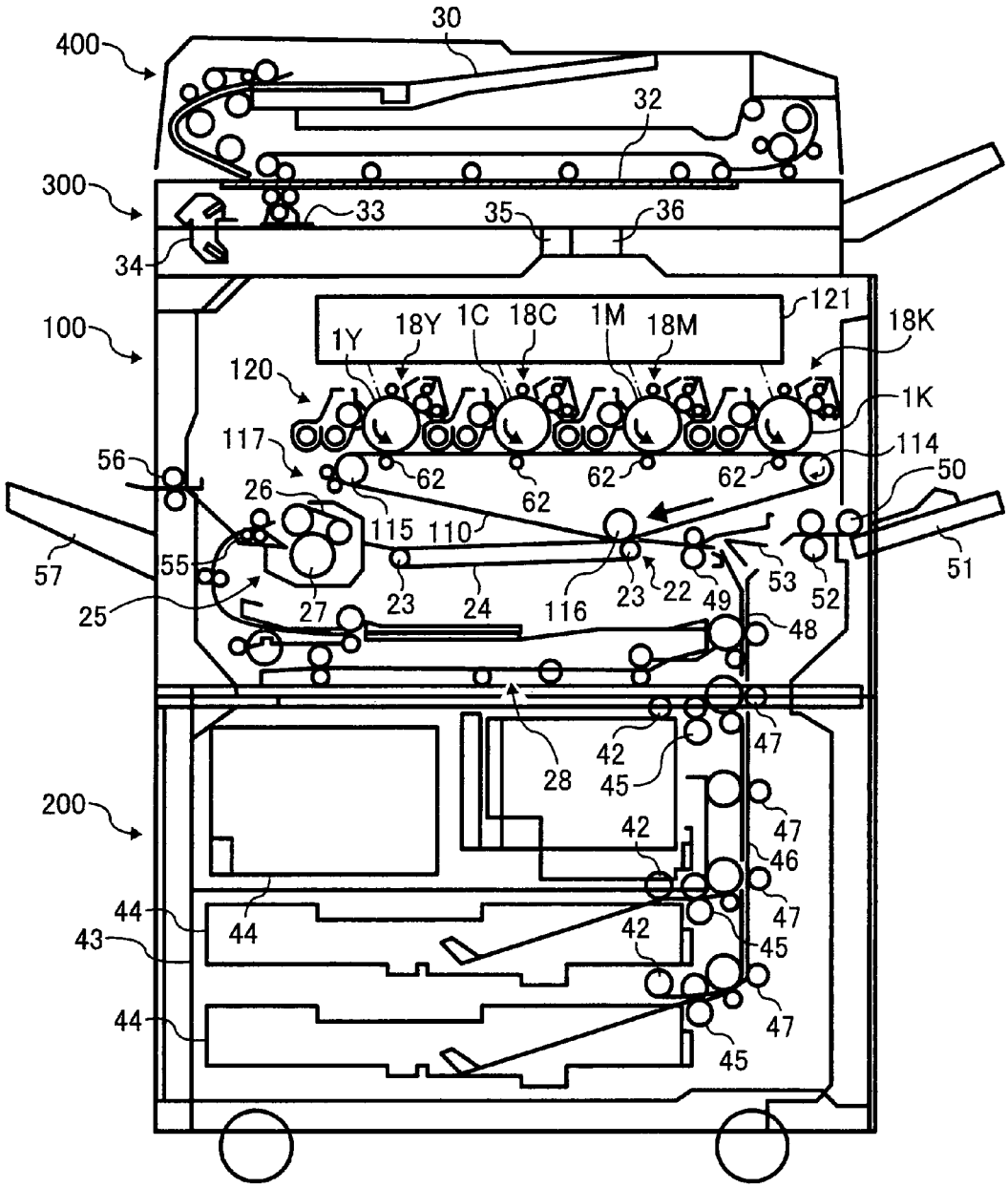
FIG. 7 is a cross-sectional view illustrating the structure of an image forming apparatus according to an example embodiment of the present invention.

The tandem-type image forming device 120 of FIG. 3 may be incorporated in any desired image forming apparatus, for example, an image forming apparatus 100 shown in FIG. 7. As shown in FIG. 7, the image forming apparatus 100 maybe placed on the top of a sheet feed device 200. Further, the image forming apparatus 100 may be provided with a scanner 300 and an automatic document feeder (ADF) 400, each of which may be mounted on the top of the image forming apparatus 100.

The image forming apparatus 100 includes an intermediate transfer body 110, which may be formed as an endless belt, in its center portion. The intermediate transfer body 110 may include a base layer, an elastic layer, and a coating layer. The base layer may be made of fluorocarbon resin that is less elastic, or a rubber material that is more elastic, and/or a less-extensible cloth. The elastic layer, which is provided on the base layer may be made of, for example, fluorocarbon rubber or acrylonitrile-butadiene copolymer rubber. The surface of the elastic layer may be covered by the coating layer having a smooth surface, such as a material made of fluorocarbon resin. The intermediate transfer body 110 which is wound around a first support roller 114, a second support roller 115, and a third support roller 116, is driven in the clockwise direction as indicated by the arrow in FIG. 1. Further, four transfer rollers 62 are provided along the intermediate transfer body 110.

In this example, an intermediate transfer body cleaning device 117 is provided left of the second support roller 115. The body cleaning device 117 removes residual toner, which may be left on a surface of the intermediate transfer body 110 after the image is transferred from the intermediate transfer body 110 to a recording sheet carried by a secondary transfer belt 24. Between the first support roller 114 and the second support roller 115, four image forming devices 18 are arranged side by side along the transfer direction of the intermediate transfer body 110 to form a tandem-type image forming device, such as the tandem-type image forming device 120.

The image forming devices 18, which may be also referred to as the tandem-type image forming device 120, include an image forming device 18Y for forming a yellow image, an image forming device 18C for forming a cyan image, an image forming device 18M for forming a magenta image, and an image forming device 18K for forming a black image. An exposure device 121 is provided above the tandem-type image forming device 120.

In this example, the image forming devices 18Y, 18C, 18M and 18K, which may be collectively referred to as the image forming device 18, each have the structure shown in FIG. 2. In the image forming device 18, the developing device 2 and the cleaning device 700 are integrally formed, for example, by being fixed to the same structure. Further, the image forming device 18 includes the driving device 11, which function as described above referring to FIG. 3. The rotator, such as the developing roller 3, the agitator 4, and the collection screw 703, may be driven by the driving device 11.

By setting different rotational speeds as described-above, less accumulated vibration is transmitted to a device provided near the driving device 11, such as the developing device 2 or the cleaning device 700. Accordingly, degradation of an image formed by the image forming device 18, such as banding of the image, may be sufficiently prevented.

A secondary transfer device 22 is provided so as to face the image forming devices 18 via the intermediate transfer body 110. In this example, the secondary transfer device 22 includes two rollers 23, and the secondary transfer belt 24 wound around the two rollers 23. The secondary transfer belt 24 may be formed as an endless belt. Further, the secondary transfer belt 24 is pushed against the third support roller 116. With this structure, the image formed on the intermediate transfer body 110 may be transferred to the recording sheet carried by the secondary transfer belt 24.

A fixing device 25 is provided at one side of the secondary transfer device 22. The fixing device 25 includes a fixing belt 26 and a pressure roller 27, which are pushed against with each other. The fixing belt 26 is formed as an endless belt. In this example, the secondary transfer device 22 is able to transfer the recording sheet having the image thereon to the fixing device 25. When the secondary transfer device 22 is implemented by a transfer roller or a non-contact type charger, this function of transferring the recording sheet is not performed by the secondary transfer device 22.

Below the secondary transfer device 22 and the fixing device 25, a reversing device 28 may be provided in parallel to the tandem-type image forming device 120. The reversing device 28 turns over the recording sheet for double-sided printing.

In operation, a user may place an original document on a document tray 30 of the ADF 400, and instruct the image forming apparatus 100 to copy the original document, for example, by pressing the START key provided on an operation panel. The ADF 400 transfers the original document toward an exposure glass 32. Alternatively, the user may open the ADF 400 upward away from the scanner 300, and place the original document on the exposure glass 32.

When the START key is pressed, the original document, which is transferred to or placed on the exposure glass 32, may be read by the scanner 300. The scanner 300 scans the original document using a first scanning body 33 and a second scanning body 34. The first scanning body 33 includes a light source irradiating a light beam toward the original document. The light reflected from the original document is directed toward the second scanning body 34. The reflected light further passes through a mirror of the second scanning body 34 and an imaging lens 35 to form an optical image on an imaging sensor 36. The imaging sensor 36 converts the optical image to an electric signal, i.e., image data.

When the START key is pressed, the intermediate transfer body 110 is rotatably driven by a drive motor through the support rollers 114, 115, and 116. In this example, one of the support rollers 114, 115, and 116 may function as a drive roller coupled to the drive motor. The exposure device 121 irradiates light beams of the respective colors toward the surfaces of the photoconductors 1Y, 1C, 1M, and 1K. The images of the respectively colors are superimposed one above the other on the surface of the recording sheet, which is carried by the intermediate transfer body 110.

Still referring to FIG. 7, the sheet feed device 200 includes a plurality of feeding rollers 42, a paper bank 43 including a plurality of sheet cassettes 44, a plurality of separation rollers 45, a sheet feeding path 46, and a plurality of transfer rollers 47. When the START key is pressed, one of the feeding rollers 42 of the sheet feed device 200 may be rotated to feed a recording sheet from one of the sheet cassettes 44. The recording sheet is separated by the corresponding one of the separation rollers 45, and transferred to the sheet feeding path 46. The transfer rollers 47 further transfer the recording sheet to a sheet feeding path 48 of the image forming apparatus 100 at the position near a registration roller 49. In this example, the registration roller 49 is connected to the ground. Alternatively, a bias may be applied to the registration roller 49.

Alternatively, when the START key is pressed, a recording sheet may be fed from a manual sheet tray 51 of the image forming apparatus 100. A sheet feeding roller 50 of the image forming apparatus 100 is rotated to feed the recording sheet, which is placed on the manual sheet tray 51. The recording sheet is then separated by a separation roller 52, and transferred to a manual feeding path 53 at the position near the registration roller 49.

At a predetermined timing, the registration roller 49 is rotated to transfer the recording sheet toward a nip formed between the intermediate transfer body 110 and the secondary transfer device 22. As the recording sheet passes through the nip, the image is transferred from the surface of the intermediate transfer body 110 to the surface of the secondary transfer device 22.

The recording sheet having the image is transferred by the secondary transfer device 22 to the fixing device 25 to be fixed by heat and pressure. A switching sprawl 55 may guide the recording sheet toward a discharge roller 56, and the recording sheet is stacked on a discharge tray 57. Alternatively, the switching sprawl 55 may guide the recording sheet toward the reversing device 28 to perform image formation on another side of the recording sheet.

After the image is transferred from the intermediate transfer body 110 to the recording sheet carried by the secondary transfer device 22, the cleaning device 117 removes residual toner, which may be left on the surface of the intermediate transfer body 110, to prepare for next image formation.

Figure 8:
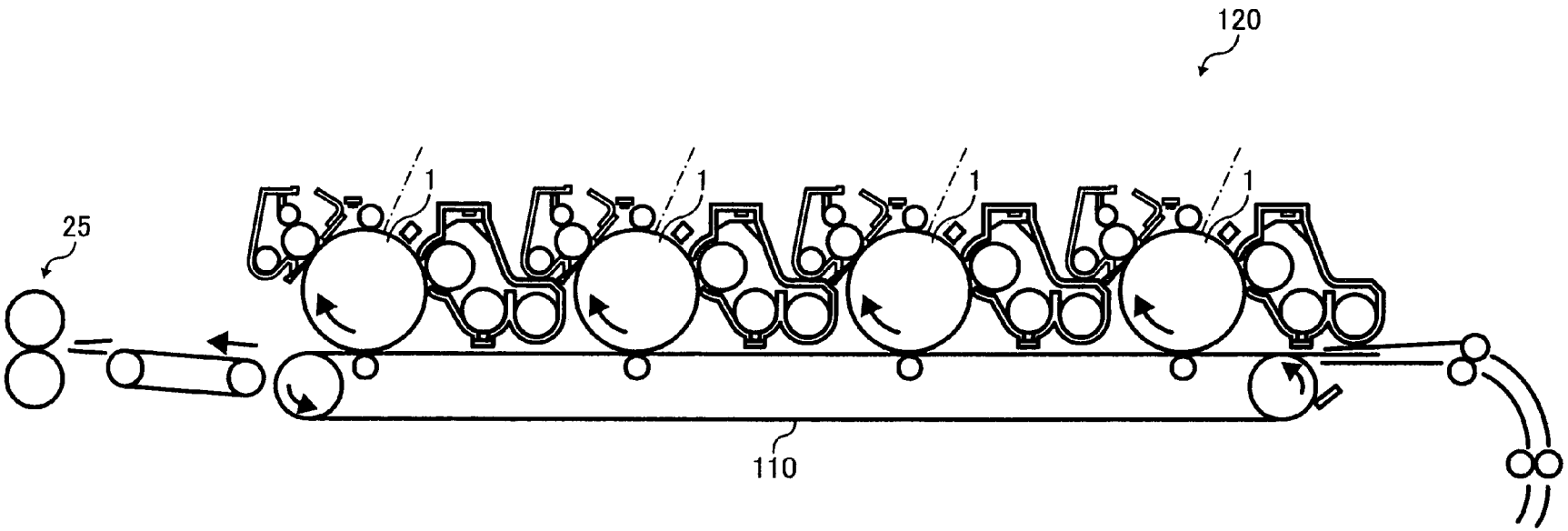
FIG. 8 is a cross-sectional view illustrating a portion of an image forming apparatus according to an example embodiment of the present invention.

In another example, the tandem-type image forming device 120 of FIG. 3 may be incorporated in an image forming apparatus having no secondary transfer device. For example, as illustrated in FIG. 8, the tandem-type image forming device 120 may be provided in a substantially similar manner as described above referring to FIG. 7. In this example, the images of the respective colors are superimposed one above the other on the surface of the recording sheet, which is carried by the intermediate transfer body 110. The recording sheet having the image thereon is then transferred to the fixing device 25.

In another example, the intermediate transfer body 110 may be formed differently, for example, as a roller.

Numerous additional modifications and variations are possible in light of the above teachings. It is therefore to be understood that within the scope of the appended claims, the disclosure of this patent specification may be practiced in ways other than those specifically described herein.

For example, elements and/or features of different illustrative embodiments may be combined with each other and/or substituted for each other within the scope of this disclosure and appended claims.

Figure 9:
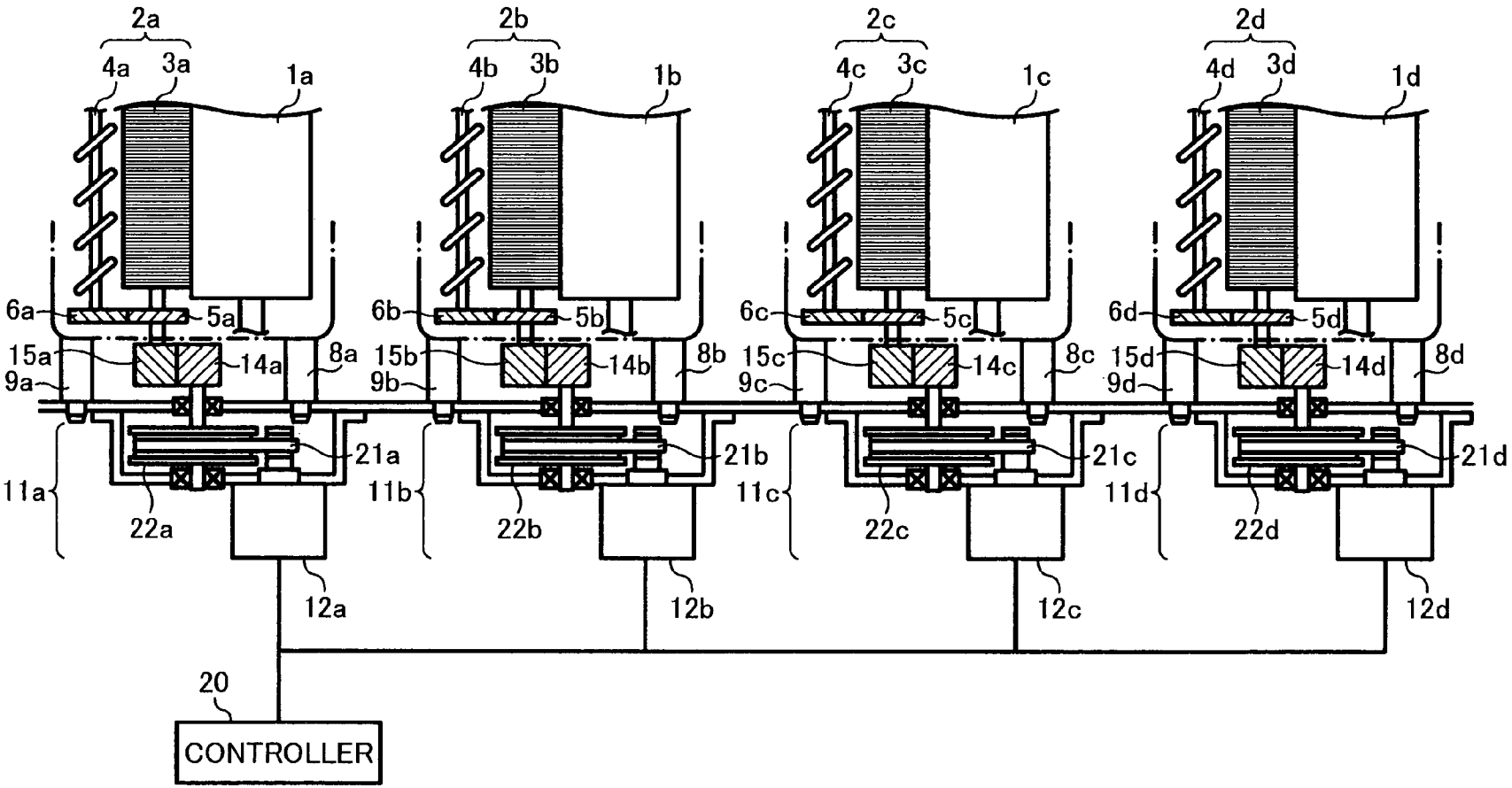
FIG. 9 is a cross-sectional view illustrating a portion of a tandem-type image forming device according to an example embodiment of the present invention.

Further, anyone of the driving devices 11*a*, 11*b*, 11*c*, and 11*d* of FIG. 3 may have a mechanical structure different from the mechanical structure shown in FIG. 3. For example, as illustrated in FIG. 9, the reduction gear 13 may be replaced by a belt 21 and a pulley 22. The drive gear 112 rotatably drives the pulley 22 via the belt 21. In this example, the reduction ratio, such as the ratio between the number of integral teeth of the belt 21 and the number of teeth of the drive gear 112, may be preferably the same for the driving devices 11*a*, 11*b*, 11*c*, and 11*d*.

Further, as described above referring to FIG. 3, the driving devices that are arranged in parallel with one another are designed to be substantially the same in mechanical structure, for example, in order to save the manufacturing cost or time. Alternatively, the mechanical structures may be designed to be different among the driving devices.

Further, as described above, the image forming devices that are arranged in parallel with one another are designed to be substantially the same in mechanical structure, for example, in order to save the manufacturing cost or time. Alternatively, the mechanical structure may be designed to be partly different among the image forming devices. For example, the image forming devices of the black color may be designed to be different from the image forming devices of the yellow, magenta, and cyan colors.

Further, as described above, the driving devices, the developing devices, and the photoconductor may be integrally formed, for example, in order to save the manufacturing cost or time. Alternatively, the driving devices, the developing devices, and the photoconductor may be provided on different structures.

Further, in this example, the rotational speed is set differently for each one of the driving devices. The rotational speed may be expressed by, for example, a number of rotations of the rotator per a predetermined time period.

Further, while the driving device 11 may be preferably used in the tandem-type image forming device 120, the driving device 11 may be used in a single-drum type image forming device having one photoconductor.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, involatile memory cards, ROM (read-only-memory), etc.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A driving device for driving first rotating means for rotating asynchronously with a photoconductor of an image forming apparatus, the driving device comprising:

first generating means for generating a drive force by rotating at a first input rotational speed; and first transmitting means for transmitting the drive force from the first generating means to the first rotating means to drive the first rotating means at a first output rotational speed converted from the first input rotational speed, the first output rotational speed being different from a second output rotational speed of second rotating means arranged in parallel with the first rotating means.

2. The device of claim 1, wherein the difference between the first output rotational speed and the second output rotational speed is equal to or greater than 2 percent.

3. The device of claim 1, further comprising:

controlling means for outputting a control signal for determining the first input rotational speed, the first input rotational speed being different from a second input rotational speed of second generating means arranged in parallel with the first generating means.

4. The device of claim 3, wherein the difference between the first input rotational speed and the second input rotational speed is equal to or greater than 2 percent.

5. The device of claim 1, wherein the first transmitting means converts the first input rotational speed to the first output rotational speed according to a first reduction ratio, and wherein the first reduction ratio is substantially equal to a second reduction ratio of second transmitting means arranged in parallel with the first transmitting means.

6. The device of claim 5, wherein the first transmitting means and the second transmitting means each comprises:

a first gear; and a second gear being meshed with the first gear, the first reduction ratio and the second reduction ratio each being defined by a ratio of a number of teeth the first gear and the second gear.

7. The device of claim 1, wherein the first rotating means is provided in an image forming device of the image forming apparatus.

8. The device within of claim 1, whereon the first output rotational speed and the second output rotatinal speed are within substantially a same range.

9. An image forming device, comprising:

a first photoconductor configured to be rotatably driven by a first photoconductor driving device;

a first rotator, provided in a vicinity of the first photoconductor, configured to be rotatably driven by a first rotator driving device at a first rotational speed;

a second photoconductor configured to be rotational driven by second photoconductor driving device;

a second rotator, provided in a vicinity of the second photoconductor, configured to be rotatably driven by a second rotator driving device at a second rotational speed, the second rotational speed being different from the first rotational speed, wherein the first rotational speed and the second rotational speed are within substantially a same range and the first rotator and the second rotator arranged in parallel.

10. The device of claim 9, wherein the difference between the first rotational speed and the second rotational speed is equal to or greater than 2 percent.

11. An image forming apparatus, comprising:

a plurality of image forming devices as claimed in claim 9.

12. The image forming apparatus of claim 11, wherein the difference between the first rotational speed and the second rotational speed, in each image forming device, is equal to or greater than 2 percent.

13. An image forming apparatus, comprising:

a plurality of image forming devices, each one of the plurality of image forming devices comprising:

a photoconductor configured to rotate; and a rotator, provided in a vicinity of the photoconductor, configured to rotate asynchronously with the rotation of the photoconductor, a rotational speed of the rotator being different for each one of the plurality of image forming devices.

14. The apparatus of claim 13, wherein the difference in rotational speed of the rotator between at least two of the plurality of image forming devices is equal to or greater than 2 percent.

15. The apparatus of claim 13, further comprising:

a plurality of driving devices arranged side by side and each provided in a vicinity of each one of the plurality of image forming devices, each one of the plurality of driving devices comprising:

a drive motor to generate a drive force according to a control signal; and a force transmitter to transmit the drive force from the drive motor to the rotator, the rotator being rotated by the drive force.

16. The apparatus of claim 15, wherein a mechanical structure of the force transmitter is designed to be substantially similar for the plurality of driving devices.

17. The apparatus of claim 15, wherein the plurality of driving devices are designed to be substantially similar in mechanical structure.

18. The apparatus of claim 15, wherein the plurality of driving devices are integrally provided.

19. The apparatus of claim 13, further comprising:

a developing device, provided in a vicinity of the photoconductor, to develop an electrostatic latent image formed on a surface of the photoconductor into a toner image;

a transfer device, provided in a vicinity of the photoconductor, to transfer the toner image from the surface of the photoconductor; and a cleaning device, provided in a vicinity of the photoconductor, to clean the surface of the photoconductor after transfer of the toner image, the rotator being provided in at least one of the developing device and the cleaning device.

20. The apparatus of claim 19, wherein the developing device and the cleaning device are integrally provided.

21. The apparatus of claim 19, further comprising:

an applying device, provided in a vicinity of the photoconductor, to apply a lubricant agent to a surface of the photoconductor, wherein the rotator is provided in at least one of the developing device, the cleaning device, and the applying device.

* * * * *